United States Patent [19]

Komatsu

[11] Patent Number: 5,000,694

[45] Date of Patent: Mar. 19, 1991

[54] IC CARD CONNECTOR

[75] Inventor: Yasuhiro Komatsu, Osaka, Japan

[73] Assignee: Hosiden Electronics Co., Ltd., Yao, Japan

[21] Appl. No.: 478,838

[22] Filed: Feb. 12, 1990

[30] Foreign Application Priority Data

Mar. 1, 1989 [JP] Japan ..... 1-23742[U]

[51] Int. Cl.[5] ..... H01R 13/62

[52] U.S. Cl. ..... 439/260; 439/325; 439/331

[58] Field of Search ..... 439/260, 265, 267, 270, 439/259, 331, 325, 326, 327, 629, 630, 631, 636

[56] References Cited

U.S. PATENT DOCUMENTS 2,965,811 12/1960 Batcher ..... 439/259 X 4,261,631 4/1981 Guilcher et al. ..... 439/325 X 4,553,805 11/1985 Aikens ..... 439/325

4,639,063 1/1987 Mueller ..... 439/325

*Primary Examiner*—Neil Abrams

*Assistant Examiner*—Khiem Nguyen

*Attorney, Agent, or Firm*—Jones, Tullar & Cooper

[57] ABSTRACT

The present invention relates to an IC card connector in whcih an IC card is inserted into gaps between a contact arrangement surface formed in a housing of the connector, and a pushing plate vertically movable with respect to the housing. After the IC card has been inserted, the pushing plate is pushed toward the contact arrangement surface by pushing mechanisms, so that the IC card is contact-pressed to the contacts on the contact arrangement surface, through the pushing plate. The pushing mechanisms may be formed by, for example, levers rotatable between first positions where the levers cross the pushing plate immediately above the same and second positions where the levers do not cross the pushing plate.

10 Claims, 3 Drawing Sheets

IC CARD CONNECTOR

BACKGROUND OF THE INVENTION

1. Field of the Invention

The present invention relates to a multi-pole connector suitably used for an IC card serving, for example, a CPU function thereby enabling execution of a variety of information processings.

2. Description of the Prior At

A conventional IC card connector has contacts the number of which corresponds to the number of contacts formed on one or both sides of an IC card, the latter number of contacts being relatively small.

Recently, it has been proposed to provide an IC card with the capability of serving a CPU function so that a variety of information processings can be executed with the use of such an IC card. As compared with a general ROM card, the IC card having a CPU function, has a great number of poles (for examples, 240 poles). Accordingly, if a ROM card connector is used as modified in design merely in such a simple manner as to increase the number of the poles, this presents the problem that the contact-pressures between the contacts of an IC card and the contacts of the connector are not sufficient, thereby lowering reliability in view of the electrical connection.

SUMMARY OF THE INVENTION

In view of the foregoing, the present invention is proposed with the object of providing an IC card connector in which the number of contact poles may be considerably increased as compared with that of a conventional connector, and in which, even though the number of the contacts of the connector is increased, the contacts of an IC card may come in contact with the contacts of the connector with sufficiently great contact-pressures.

To achieve the object above-mentioned, the IC card connector in accordance with the present invention comprises:

- a housing;
- a flat-plate portion formed in the housing and having a surface serving as a contact arrangement surface;
- brackets standing from both lateral sides of the housing;
- contacts arranged on the contact arrangement surface;
- a pushing plate disposed as facing and crossing the contact arrangement surface, both ends of the pushing plate being respectively so held by the brackets as to be vertically movable in a predetermined area; and
- pushing mechanisms arranged such that, when an IC card is inserted into gaps between the pushing plate and the contact arrangement surface of the housing, the pushing mechanisms are adapted to push the IC card to the contact arrangement surface through the pushing plate.

According to the IC card connector having the arrangement above-mentioned, the pushing mechanisms cause the IC card to be pushed toward the contact arrangement surface through the pushing plate disposed as crossing the contact arrangement surface of the housing. Accordingly, the respective portions of the IC card, i.e., a number of contacts formed on the IC card, are respectively pushed with sufficiently great forces, causing these contacts to securely come in contact with the contacts arranged on the contact arrangement surface. Further, the flat-plate portion of the housing which serves as the contact arrangement surface, overlaps the support frame. Accordingly, the pushing forces applied to the flat-plate portion are substantially received by the support frame. This prevents the flat-plate portion having the contact arrangement surface from being bent. Accordingly, the IC card connector of the present invention is very reliable as an IC card connector having multi-pole contacts.

According to the IC card connector of the present invention, a number of slits may be formed in the flat-plate portion, and the contacts may be respectively disposed in these slits with the tops of the contacts projecting toward the pushing plate. Thus, the contacts may be disposed on the contact arrangement surface. According to such an arrangement, the tops of the contacts projecting toward the pushing plate are fitted, as pushed by the IC card, into the slits. Accordingly, the contacts are contact-pressed, by the resiliency thereof, to the IC card. When the projecting amounts of the contact tops are made uniform, the respective contacts may be readily contact-pressed to the IC card with uniform forces.

According to the IC card connector having the arrangement above-mentioned, the housing may be mounted on a metallic support frame having great rigidity and the brackets may be integrally formed with this support frame. Thus, brackets having great rigidity may be disposed, and the rigidity of the IC card connector in its entirety may be further enhanced.

According to the present invention, the IC card connector may have pushing mechanisms which have horizontally extending levers rotatable between first positions where the levers cross the pushing plate immediately above the same, and second positions where the levers do not cross the pushing plate. When the levers are rotated to the first positions, the levers push an IC card inserted into the connector, toward the contact arrangement surface through the pushing plate. By these pushing mechanisms, the pushing plate may be longitudinally uniformly pushed from the above.

According to the present invention, the IC card connector may have pushing mechanisms comprising bolts which project from the pushing plate and which do not come out from the housing; and nuts threadedly connected to those portions of the bolts which project from the pushing plate. Such pushing mechanisms may be readily accommodated to variations of the thickness of the IC card.

According to the present invention, the IC card connector may have pushing mechanisms comprising substantially U-shaped hooks rotatably attached to the housing. When the hooks are engaged with the ends of the pushing plate which project outside of the brackets, the hooks push the pushing plate toward the contact arrangement surface. Such pushing mechanisms are suitably adopted when an operating space is not available at the upper portion of the connector.

According to the present invention, the IC card connector may have pushing mechanisms comprising levers provided at the base ends thereof with cam surfaces, the base ends being rotatably attached to the brackets. When the levers are rotated after an IC card has been inserted, the cam surfaces push the pushing plate. According to such pushing mechanisms, the pushing forces may be given and released by a very simple operation.

DETAILED DESCRIPTION OF THE PREFERRED EMBODIMENT

Figure 1:
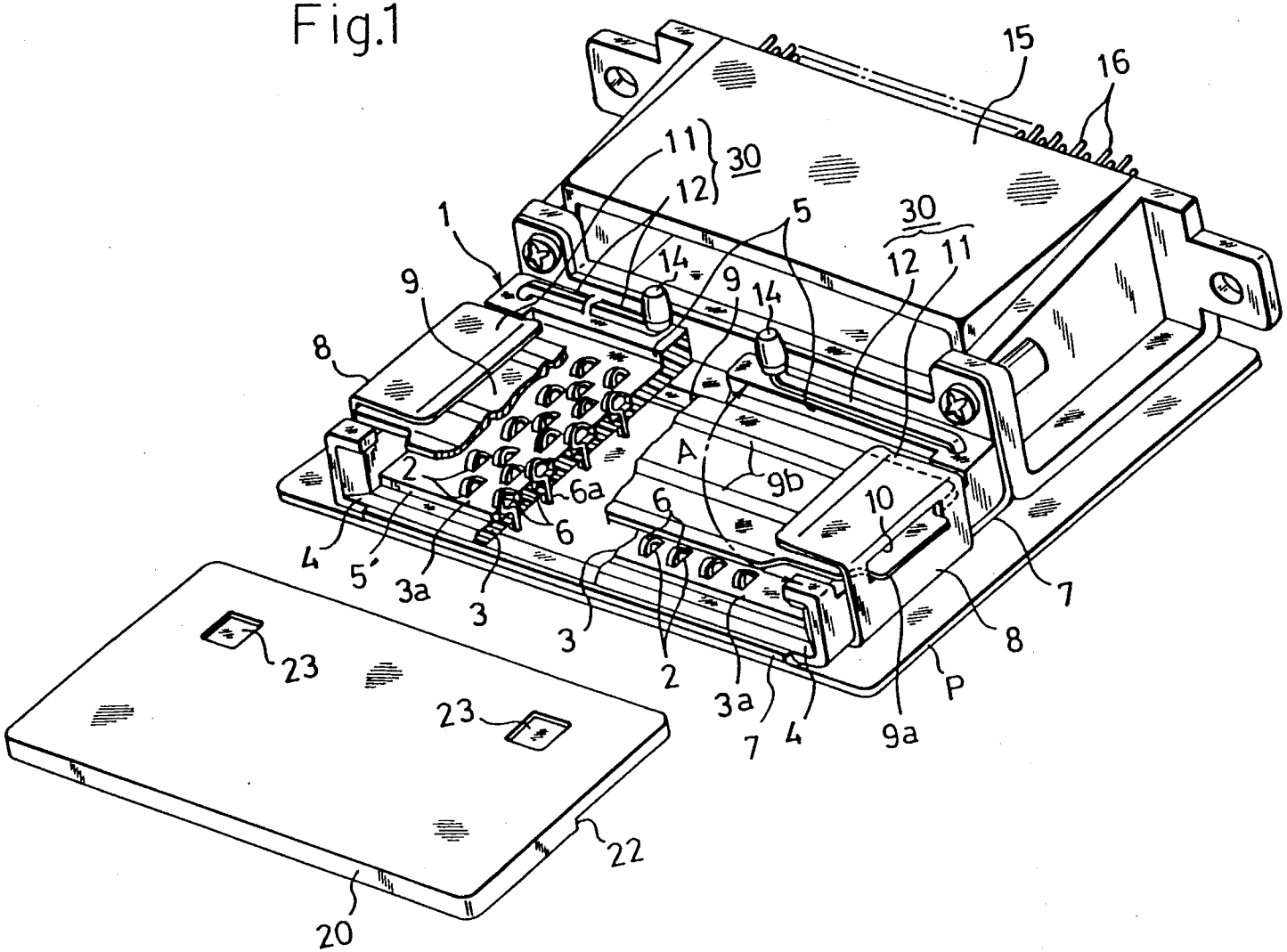
FIG. 1 is a perspective view of an IC card connector in accordance with the present invention, and an IC card to which the connector is applied.
Figure 3:
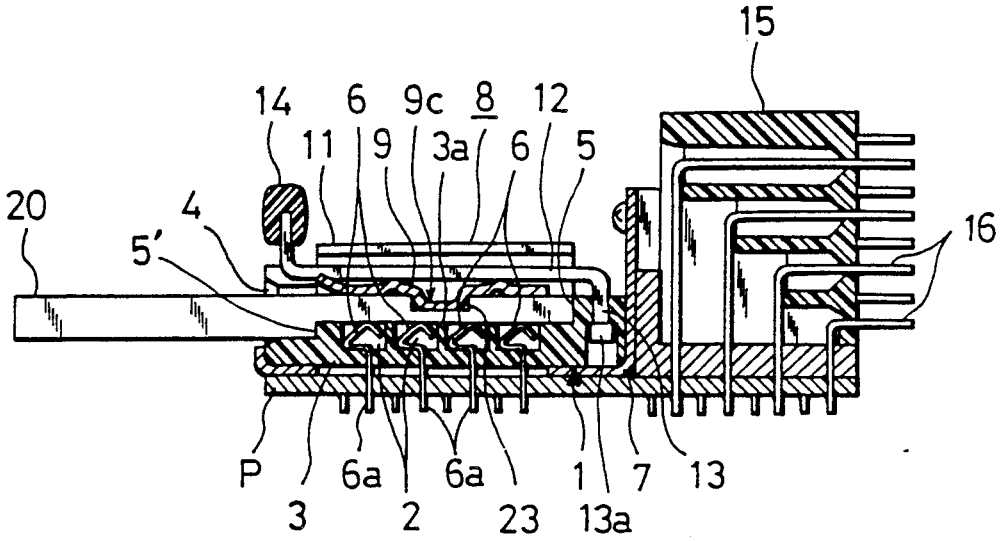
FIG. 3 is a vertical section view in side elevation of the connector in FIG. 1, illustrating the state where the connector is in use.

As shown in FIGS. 1 and 3, the IC card connector of the present invention has a housing 1 having a flat-plate portion 3, a card inserting/removing port 4 and stepped portions 5, 5', these housing members being integrally molded from synthetic resin. The flat-plate portion 3 has a number of slits 2 arranged in zigzags or in the form of a lattice. The card inserting/removing port 4 is formed by a flat quadrilateral frame the top surface of which is removed substantially in its entirety. The left- and right-hand lateral sides and the inner peripheral wall of the lower side of the frame forming the card inserting/removing port 4, are inclined in such directions to extend the opening area of the card inserting-/removing port 4. The lower side of the frame is extended to the front end of the flat-plate portion 3. The stepped portion 5 stands from the flat-plate portion 3 at the rear end thereof, and the front side of the stepped portion 5 faces the card inserting/removing port 4. The stepped portion 5' is formed at the boundary between the front end of the flat-plate portion 3 and the lower side of the frame. Likewise in the stepped portion 5, the front side of the stepped portion 5' faces the card inserting/removing port 4.

Contacts 6 are respectively disposed in the slits 2 in the flat-plate portion 3. That is, the surface of the flat-plate portion 3 serves as a contact arrangement surface 3*a*. The number of the contacts 6 is set to, for example, 240 and the contacts 6 form a multi-pole contact group. Each of the contacts 6 has a terminal 6*a* which passes through the flat-plate portion 3 and which is soldered to the circuit pattern of a printed circuit board P.

The housing 1 is put on a support frame 7 made of metal having great rigidity, and this support frame 7 is mounted on the printed circuit board P. At both lateral sides of the housing 1, there stand brackets 8 integrally formed with the metallic support frame 7. Each of the brackets 8 has a hole 10. Each of the brackets 8 is provided at the upper end thereof with an inwardly turned backup piece 11 which is formed by turning the free end of each bracket 8.

A pushing plate 9 extends across and faces the contact arrangement surface 3*a* of the housing 1. This pushing plate 9 is made of a metallic plate having great rigidity. The pushing plate 9 is provided at both transverse ends thereof with projecting pieces 9*a* which are vertically movably fitted in the holes 10 in the brackets 8, respectively. In the embodiment shown in FIG. 1, the pushing plate 9 has ribs 9*b* to further enhance the bending rigidity of the pushing plate 9. The front side of the pushing plate 9 is slightly upwardly turned to facilitate the insertion of a IC card.

Horizontally extending levers 12 are provided at the base ends thereof with downwardly extending shaft portions 13, and at the tip ends thereof with upwardly extending handles 14. The shaft portions 13 are rotatably inserted into the rear end of the housing 1. When the levers 12 are reciprocatingly rotated in a direction shown by the arrow A in FIG. 1 with the handles 12 held by the hands, the levers 14 are inserted in and removed from gaps between the backup pieces 11 and the pushing plate 9. The shaft portions 13 are inserted into the rear end of the housing 1 such that the shaft portions 13 are vertically movable in a predetermined stroke range. More specifically, to restrain the amount of upward movement of the shaft portions 13 and the levers 12, the shaft portions 13 are provided at the lower ends thereof with large-diameter portions 13*a* engaged with the housing 1. The amount of upward movement to be restrained by the large-diameter portions 13*a* is set according to the thicknesses of the IC card 20 and the pushing plate 9. That is, the amount of movement moving amounts is set such that the levers 12 inserted into gaps between the pushing plate 9 and the backup pieces 11, cause the pushing plate 9 to push the IC card 20 toward the contact arrangement surface 3*a* with a uniform force throughout the longitudinal area of the IC card 20.

A terminal box 15, shown in FIGS. 1 and 3 houses a plurality of contact pieces 16 soldered to the circuit pattern of the printed circuit board P. These contact pieces 16 are connected, through a connector or as soldered, to an information processing device (not shown).

Figure 2:
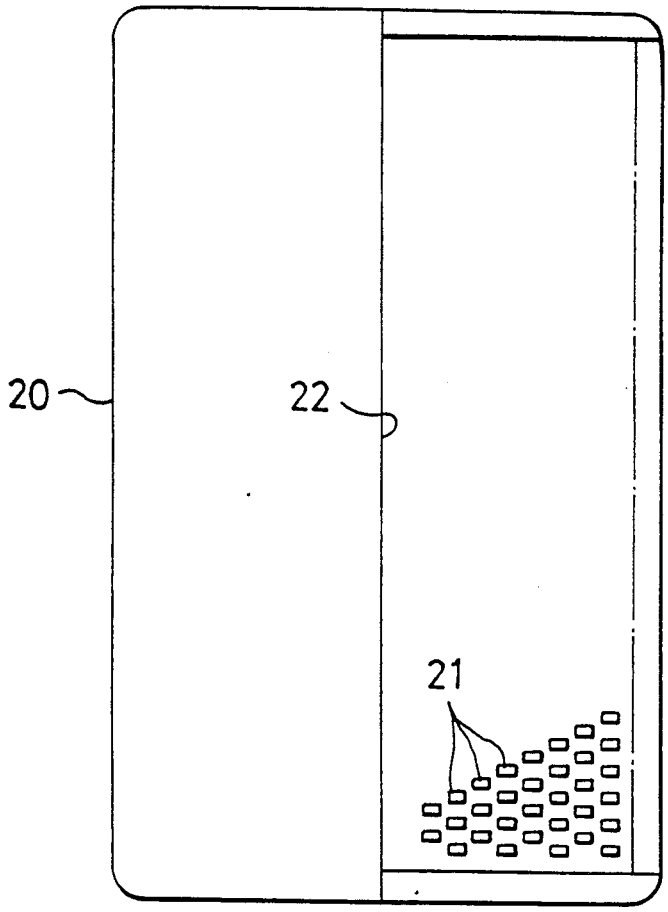
FIG. 2 is a back plan view of the IC card in FIG. 1.

As shown in FIG. 2, the IC card 20 has a plurality of contacts 21, which are arranged in the same format as that of the contacts 6 arranged on the contact arrangement surface 3*a* of the housing 1. That is, the contacts 21 respectively correspond to the contacts 6. The IC card 20 is provided on the reverse side thereof with a stepped portion 22. The IC card 20 has positioning concave portions 23 into which convex portions 9*c* formed on the pushing plate 9 are adapted to be fitted, thereby preventing the card from coming off from the connector.

With the arrangement above-mentioned, when the IC card 20 is inserted through the card inserting/removing port 4, the IC card 20 is pushed, while pushing up the pushing plate 9, into the gap between the pushing plate 9 and the contact arrangement surface 3*a*. This causes a number of contacts 21 of the IC card 20 to come in slight contact with a number of contacts 6 on the contact arrangement surface 3*a*. When the IC card 20 is pushed into a predetermined position, the stepped portion 22 of the IC card 20 or the tip of the IC card 20 comes in contact with the stepped portion 5 or 5' of the housing 1. At the same time, the convex portions 9*c* formed on the pushing plate 9 are fitted into the concave portions 23 of the IC card 20. Thus, the IC card 20 is so positioned as to be slightly movable in the vertical direction.

Then, the levers 12 are so rotated as to be inserted into the gaps between the backup pieces 11 and the pushing plate 9. This causes the levers 12 to push the pushing plate 9. The pushing plate 9, in turn, pushes the IC card 20 toward the contact arrangement surface 3a with a uniform force in the longitudinal direction. This causes the respective contacts 21 of the IC card 20 to be securely contact-pressed to the respective contacts 6 on the contact arrangement surface *3a*. The pushing force exerted, at this time, to the flat-plate portion 3 is ultimately received by the support frame 7, which has excellent rigidity. This prevents the flat-plate portion 3 from being bent, due to the pushing force above-mentioned, which would lower the reliability of contact between the contacts 6 and the contacts 21.

Provision may be made such that the levers 12 inserted into the gaps between the backup pieces 11 and the pushing plate 9, apply a wedging action. In this case, the contacts 6 and the contacts 21 are further securely contact-pressed to each other.

When removing the IC card 20 from the connector, the levers 12 are rotated in the opposite direction, causing the levers 12 to be pulled out from the gaps between the backup pieces 11 and the pushing plate 9. This causes the pushing plate 9 to be returned to the original position where the pushing plate 9 is slightly movable in the vertical direction. Thus, the IC card 20 may be readily pulled out.

According to this embodiment, the levers 12 and the brackets 8 constitute pushing mechanisms 30 of the one-action type for pushing the IC card 20 toward the contact arrangement surface *3a*. However, the pushing mechanisms 30 are not limited to those shown in FIG. 1, but a variety of known mechanisms may also be jointly used. FIG. 4A to FIG. 6 show pushing mechanisms including known mechanisms.

Figure 4A:
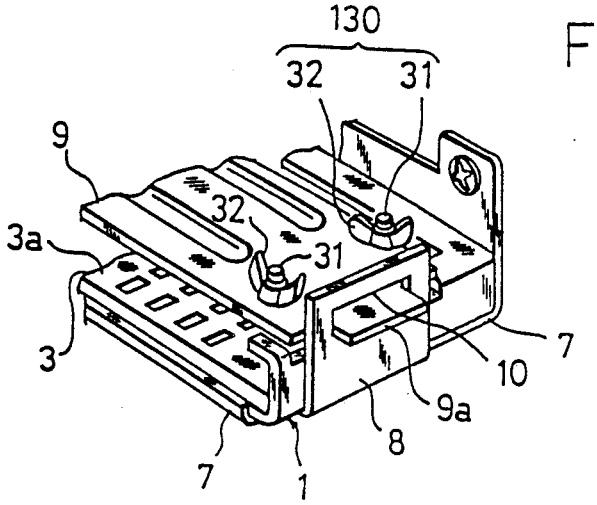
FIG. 4A is a perspective view of certain main portions of the IC card connector illustrating an example of pushing mechanisms.
Figure 4B:
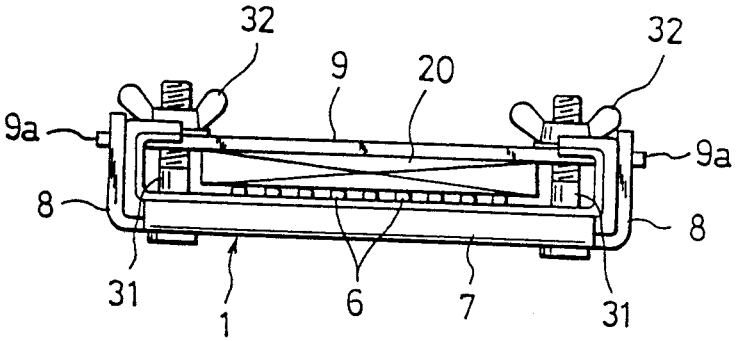
FIG. 4B is a front view of the IC card connector in FIG. 4A.

Each of pushing mechanisms 130 shown in FIGS. 4A and FIG. 4B comprises bolts 31 and fly nuts 32. The bolts 31 pass through the pushing plate 9 from the reverse side of the support frame 7, and project upwardly from the pushing plate 9. The bolts 31 are secured to the reverse side of the support frame 7. The bolts 31 pass through the transverse ends of the pushing plate 9 such that the pushing plate 9 is vertically movable. The fly nuts 32 are threadedly connected to those portions of the bolts 31 which project upwardly from the pushing plate 9. According to the pushing mechanisms 130, when inserting/removing an IC card, the fly nuts 32 are loosened to cause the pushing plate 9 to be vertically movable. With the IC card inserted into a predetermined position, the fly nuts 32 are fastened. The fastening forces cause the IC card 20 to be pushed, through the pushing plate 9, 5 toward the contact arrangement surface *3a*. Accordingly, the pushing mechanisms 130 may be readily accommodated to slight variations of the thickness of the IC card 20 used.

Figure 5:
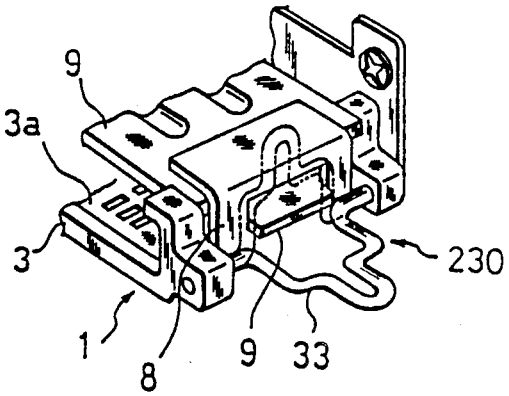
FIG. 5 is a perspective view of certain main portions of the IC card connector illustrating a further example of the pushing mechanisms.

Each of pushing mechanisms 230 shown in FIG. 5 comprises a substantially U-shape hook 33 rotatable around a transverse shaft, the hook 33 being attached to the housing 1. According to the pushing mechanisms 230, the hooks 33 may be raised and engaged with the projecting pieces *9a* of the pushing plate 9 as shown by a virtual line in FIG. 5. By the fastening forces of the hooks 33, the IC card may be pushed toward the contact arrangement surface *3a* through the pushing plate 9. The pushing mechanisms 230 may be disposed at the lateral sides of the housing. Accordingly, when no operating space is available at the upper portion of the connector, these pushing mechanisms 230 may be suitably adopted.

Figure 6:
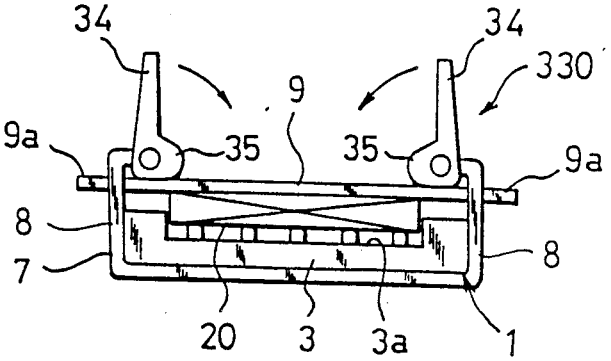
FIG. 6 is a perspective view of certain main portions of the IC card connector illustrating still another example of the pushing mechanisms.

In pushing mechanisms 330 in FIG. 6, the bases of levers 34 are rotatably attached to the upper ends of the brackets 8 standing at both sides of the housing 1. Cam surfaces 35 are formed at the base portions of the levers 34. When the levers 34 are positioned as raised, the cam surfaces 35 do not act on the pushing plate 9. When, with the IC card 20 inserted into the connector, the levers 34 are thrown down as shown by arrows in FIG. 6, the cam surfaces 35 push down the pushing plate 9, causing the IC card 20 to be pushed toward the contact arrangement surface *3a*. According to the pushing mechanisms 330, the pushing forces may be readily given or released by operating the levers 34.

In FIG. 4A to FIG. 6, other arrangement than the pushing mechanisms may be the same as that of the IC card connector described in connection with FIGS. 1 to 3.

What is claimed is:

1. An IC card connector comprising:

a metallic support frame have great rigidity;

a housing mounted on said support frame;

a flat-plate portion formed in said housing and having a surface serving as a contact arrangement surface;

brackets standing from both lateral sides of said housing and integrally formed with said support frame;

contacts arranged on said outlet arrangement surface;

a pushing plate disposed as facing and crossing said contact arrangement surface, both ends of said pushing plate being respectively so held by said brackets as to be vertically movable in a predetermined area; and pushing mechanisms arranged such that, when an IC card is inserted into gaps between said pushing plate and said contact arrangement surface of said housing, said pushing mechanisms are adapted to push said IC card to said contact arrangement surface through said pushing plate.

2. An IC card connector as set forth in claim 1, wherein the pushing mechanisms comprise: bolts which project from the pushing plate and which do not come out from the housing; and nuts threadedly connected to those portions of said bolts which project from said pushing plate.

3. An IC card connector as set forth in claim 1, wherein the pushing mechanisms comprise substantially U-shape hooks rotatably attached to the housing, said hooks being adapted to push the pushing plate toward the contact arrangement surface when said hooks are engaged with the ends of said pushing plate which project outside of the brackets.

4. An IC card connector as set forth in claim 1, wherein the pushing mechanisms comprise levers provided at the base ends thereof with cam surfaces, said base ends being rotatably attached to the brackets, said cam surfaces being adapted to push the pushing plate when said levers are rotated after an IC card has been inserted

5. An IC card connector comprising:

a metallic support frame having great rigidity;

a housing mounted on said support frame;

a flat-plate portion formed in said housing and having a surface serving as a contact arrangement surface, said flat-plate portion having a number of slits formed therein;

brackets standing from both lateral sides of said housing and integrally formed with said support frame;

contacts arranged on said contact arrangement surface;

a pushing plate disposed as facing and crossing said contact arrangement surface, both ends of said pushing plate being respectively so held by said brackets as to be vertically movable in a predetermined area; and pushing mechanisms arranged such that, when an IC card is inserted into gaps between said pushing plate and said contact arrangement surface of said housing, said pushing mechanisms are adapted to push said IC card to said contact arrangement surface through said pushing plate, wherein the contacts are respectively disposed in said slits with the tops of said contacts projecting toward said pushing plate.

6. An IC card connector as set forth in claim 5, wherein the pushing mechanisms have horizontally extending levers rotatable between first positions where said levers cross the pushing plate immediately above the same and second positions where said levers do not cross said pushing plate, said levers being adapted to push an IC card inserted into said connector, toward the contact arrangement surface through said pushing plate when said levers are rotated to said first positions.

7. An IC card connector as set forth in claim 5, wherein the pushing mechanisms comprise bolts which project from the pushing plate and which do not come out from the housing; and nuts threadedly connected to those portions of said bolts which project from said pushing plate.

8. An IC card connector as set forth in claim 5, wherein the pushing mechanisms comprise substantially U-shaped hooks rotatably attached to the being adapted to push the pushing plate toward the contact arrangement surface when said hooks are engaged with the ends of said pushing plate which project outside of the brackets.

9. An IC card connector as set forth in claim housing, said hooks. 5, wherein the pushing mechanisms comprise levers provided at the base ends thereof with cam surfaces, said base ends being rotatably attached to the brackets, said cam surfaces being adapted to push the pushing plate when said levers are rotated after an IC card has been inserted.

10. An IC card connector comprising:

a housing;

a flat-plate portion formed in said housing and having a surface serving as a contact arrangement surface;

brackets standing from both lateral sides of said housing;

contacts arranged on said contact arrangement surface;

a pushing plate disposed as facing and crossing said contact arrangement surface, both ends of said pushing plate being respectively so held by said brackets as to be vertically movable in a predetermined area; and pushing mechanisms arranged such that, when an IC card is inserted into gaps between said pushing plate and said contact arrangement surface of said housing, said pushing mechanisms are adapted to push said IC card to said contact arrangement surface through said pushing plate, wherein the pushing mechanisms have horizontally extending levers rotatable between first positions where said levers cross said pushing plate immediately above the same and second positions where said levers do not cross said pushing plate, said levers being adapted to push an IC card inserted into said connector, toward the contact arrangement surface through said pushing plate when said levers are rotated to said first positions.

* * * * *

UNITED STATES PATENT AND TRADEMARK OFFICE

CERTIFICATE OF CORRECTION

PATENT NO. : 5,000,694

DATED : March 19, 1991

INVENTOR(S) : Yasuhiro Komatsu

It is certified that error appears in the above-identified patent and that said Letters Patent is hereby corrected as shown below:

Claim 1, column 6, line 28, "outlet" should be "contact".

Claim 7, column 7, line 28, the ":" should be inserted after "comprise".

Claim 8, column 7, line 36, "U-shaped" should be "U-shape" and "housing, said hooks" should be inserted between "the" and "being".

Claim 9, column 8, line 3, "housing," should be deleted.

Claim 9, column 8, line 4, "said hooks" should be deleted.

Signed and Sealed this

Twenty-fifth Day of August, 1992

*Attest:*

DOUGLAS B. COMER

*Attesting Officer*

*Acting Commissioner of Patents and Trademarks*